US009459053B2

(12) United States Patent
Lee et al.

(10) Patent No.: US 9,459,053 B2
(45) Date of Patent: Oct. 4, 2016

(54) HEAT EXCHANGER AND AIR-CONDITIONING APPARATUS

(71) Applicants: Sangmu Lee, Tokyo (JP); Takuya Matsuda, Tokyo (JP); Akira Ishibashi, Tokyo (JP); Takashi Okazaki, Tokyo (JP)

(72) Inventors: Sangmu Lee, Tokyo (JP); Takuya Matsuda, Tokyo (JP); Akira Ishibashi, Tokyo (JP); Takashi Okazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 188 days.

(21) Appl. No.: 14/391,185

(22) PCT Filed: Apr. 23, 2013

(86) PCT No.: PCT/JP2013/061887

§ 371 (c)(1),
(2) Date: Oct. 8, 2014

(87) PCT Pub. No.: WO2013/161802

PCT Pub. Date: Oct. 31, 2013

(65) Prior Publication Data

US 2015/0068244 A1 Mar. 12, 2015

(30) Foreign Application Priority Data

Apr. 26, 2012 (WO) ..... PCT/JP2012/002858

(51) Int. Cl.
*F25B 39/02* (2006.01)
*F28D 9/00* (2006.01)
(Continued)

(52) U.S. Cl.
CPC ..... *F28D 9/0062* (2013.01); *F25B 1/005* (2013.01); *F28D 1/0535* (2013.01); *F28F 1/022* (2013.01); *F28F 1/128* (2013.01); *F28F 1/325* (2013.01);
(Continued)

(58) Field of Classification Search
CPC .... F25B 39/028; F25B 39/02; F25B 39/022; F28D 1/0358; F28F 1/12
USPC ..... 62/498, 515, 525; 165/148, 150, 181
See application file for complete search history.

(56) References Cited

U.S. PATENT DOCUMENTS 5,360,060 A 11/1994 Tanaka et al.
5,896,920 A 4/1999 Jun
5,927,392 A 7/1999 Youn et al.

FOREIGN PATENT DOCUMENTS

CN 101430143 A 5/2009
DE 102008020230 A1 10/2008
(Continued)

OTHER PUBLICATIONS

Office Action mailed Jun. 2, 2015 issued in corresponding JP patent application No. 2014-512603 (and English translation).
(Continued)

*Primary Examiner* — Melvin Jones
(74) *Attorney, Agent, or Firm* — Posz Law Group, PLC

(57) ABSTRACT

A plate fin includes a slit structure formed by cutting and raising a portion of the plate fin to form an opening facing a flow direction of a fluid and a waffle structure formed by bending a portion of the plate fin to form a protrusion having an angle-shaped cross section which protrudes in a stack direction and having a ridge substantially perpendicular to the air flow direction, and the waffle structure is disposed on the upstream side on the plate fins with respect to the slit structure and a slant length L1 on the upstream side of the waffle structure is smaller than a slant length L2 on the downstream side of the waffle structure.

11 Claims, 11 Drawing Sheets

(51) Int. Cl.

| | |
|---|---|
| ***F28F 17/00*** | (2006.01) |
| ***F28F 1/32*** | (2006.01) |
| ***F25B 1/00*** | (2006.01) |
| ***F28D 1/053*** | (2006.01) |
| ***F28F 1/12*** | (2006.01) |
| ***F28F 1/40*** | (2006.01) |
| ***F28F 1/02*** | (2006.01) |

(52) U.S. Cl.
CPC ..... *F28F 1/40* (2013.01); *F28F 17/005* (2013.01); *F28F 2215/10* (2013.01); *F28F 2215/12* (2013.01)

(56) References Cited

FOREIGN PATENT DOCUMENTS

| | | | |
|---|---|---|---|
| EP | 2 345 862 | A2 | 7/2011 |
| JP | 63-294494 | A | 12/1988 |
| JP | 02-071096 | A | 3/1990 |
| JP | 05-060482 | A | 3/1993 |
| JP | 05-90173 | U | 12/1993 |
| JP | 06-050688 | A | 2/1994 |
| JP | 07-32376 | U | 6/1995 |
| JP | 09-324995 | A | 12/1997 |
| JP | 10-141880 | A | 5/1998 |
| JP | 10-170183 | A | 6/1998 |
| JP | 10-339594 | A | 12/1998 |
| JP | 11-014276 | A | 1/1999 |
| JP | 2001041670 | A | 2/2001 |
| JP | 2002-031434 | A | 1/2002 |
| JP | 3367353 | B2 | 11/2002 |
| JP | 2007-017042 | A | 1/2007 |
| JP | 4122608 | B2 | 5/2008 |
| JP | 2010-048551 | A | 3/2010 |

OTHER PUBLICATIONS

International Search Report of the International Searching Authority mailed Jul. 30, 2013 for the corresponding international application No. PCT/JP2013/061887 (and English translation).
Chinese Office Action issued on Nov. 4, 2015 in the corresponding CN application No. 201380025081.4 (English translation attached).
Extended European Search Report issued Mar. 3, 2016 in the corresponding EP application No. 13781353.1.

(a)

(b)

(a)

(b)

(a)

(b)

HEAT EXCHANGER AND AIR-CONDITIONING APPARATUS

CROSS REFERENCE TO RELATED APPLICATIONS

This application is a U.S. national stage application of PCT/JP2013/061887 filed on Apr. 23, 2013, and is based on PCT/JP2012/002858 filed on Apr. 26, 2012, the contents of which are incorporated herein by reference.

TECHNICAL FIELD

The present invention relates to a heat exchanger and an air-conditioning apparatus using the heat exchanger.

BACKGROUND ART

In conventional heat exchangers, in order to improve drain performance of condensed water and improve fin thermal conductivity, it has been proposed to "form a drain groove (10) for guiding condensed water downward at a middle portion in an air flow direction (A) on a tube (2) having a flat cross sectional shape and extending in a vertical direction and a gap portion (53) at a position which faces the drain groove (10) on a corrugated fin (5) which is joined to the outer wall of the tube (2) and folded in a meandering shape so that the corrugated fin (5) is divided by the gap portion (53) into an upstream-side first fin (51) and a downstream-side second fin (52)" (for example, see Patent Literature 1).

CITATION LIST

Patent Literature

Patent Literature 1: Japanese Unexamined Patent Application Publication No. 2000-179988 (paragraphs [0017], [0018])

SUMMARY OF INVENTION

Technical Problem

Conventionally, fin tube type heat exchangers which include a plurality of heat transfer pipes and fins disposed between the heat transfer pipes are commonly used. In such heat exchangers, there is a need of improving drainage of condensed water which is condensation of moisture contained in a passing air. Particularly, in small sized heat exchangers, drainage of condensed water by the heat exchanger may be sometimes decreased, and it is necessary to further improve drainage of condensed water.

Further, when the fin tube type heat exchangers are used in a condition where frost formation occurs, there is a problem that frost formation tends to occur on the fins and the heat transfer pipes on the upstream side where an absolute humidity in the air is high, and frost formation may increase an air flow resistance and decrease an air volume, and thus decreases heat exchange capacity. Particularly, when slit structures are formed by cutting and raising a part of the fin, there is a problem that frost may often be deposited at slit portions having high thermal conductivity, and the flow of air passing between the fins is disturbed, which increases an air flow resistance and decreases a resistance to frost formation.

Further, in the heat exchangers in which the fins are brazed to the heat transfer pipes, durability of the fins substantially decrease since the fins are annealed by brazing. This may decrease a buckling strength of the fin and the fins may easily collapse. Collapse of the fins may cause a problem that the air flow resistance increases and the air volume decreases, and thus heat exchange capacity decreases.

The present invention is made to solve the above problems and provides a heat exchanger which improves drainage of condensed water and an air-conditioning apparatus using the heat exchanger.

Further, the present invention provides a heat exchanger which improves a resistance to frost formation and enhances heat exchange capacity and an air-conditioning apparatus using the heat exchanger.

Still further, the present invention provides a heat exchanger which improves rigidity of the fins and an air-conditioning apparatus using the heat exchanger.

Solution to Problem

A heat exchanger according to the present invention includes a plurality of plate fins which is stacked at predetermined intervals and allow a fluid to flow between the plate fins; and a plurality of heat transfer pipes which are disposed in the plate fins and in which a medium that exchanges heat with the fluid flows therethrough, wherein each of the plate fins includes a slit structure formed by cutting and raising a portion of the plate fin to form an opening facing a flow direction of the fluid and a waffle structure formed by bending a portion of the plate fin to form a protrusion having an angle-shaped cross section which protrudes in a stack direction of the plate fins and having a ridge substantially perpendicular to the flow direction of the fluid, and the waffle structure is disposed on the upstream side of the fluid with respect to the slit structure and a slant length on the upstream side of the protrusion is smaller than a slant length on the downstream side of the protrusion.

Advantageous Effects of Invention

According to the present invention, the waffle structure formed on the plate fin is disposed on the upstream side with respect to the slit structure, and a slant length on the upstream side of the waffle structure is smaller than a slant length on the downstream side. Accordingly, a resistance to frost formation can be improved and heat exchange capacity can be improved. Further, rigidity of the plate fin can also be improved.

DESCRIPTION OF EMBODIMENTS

Embodiment 1

Figure 1:
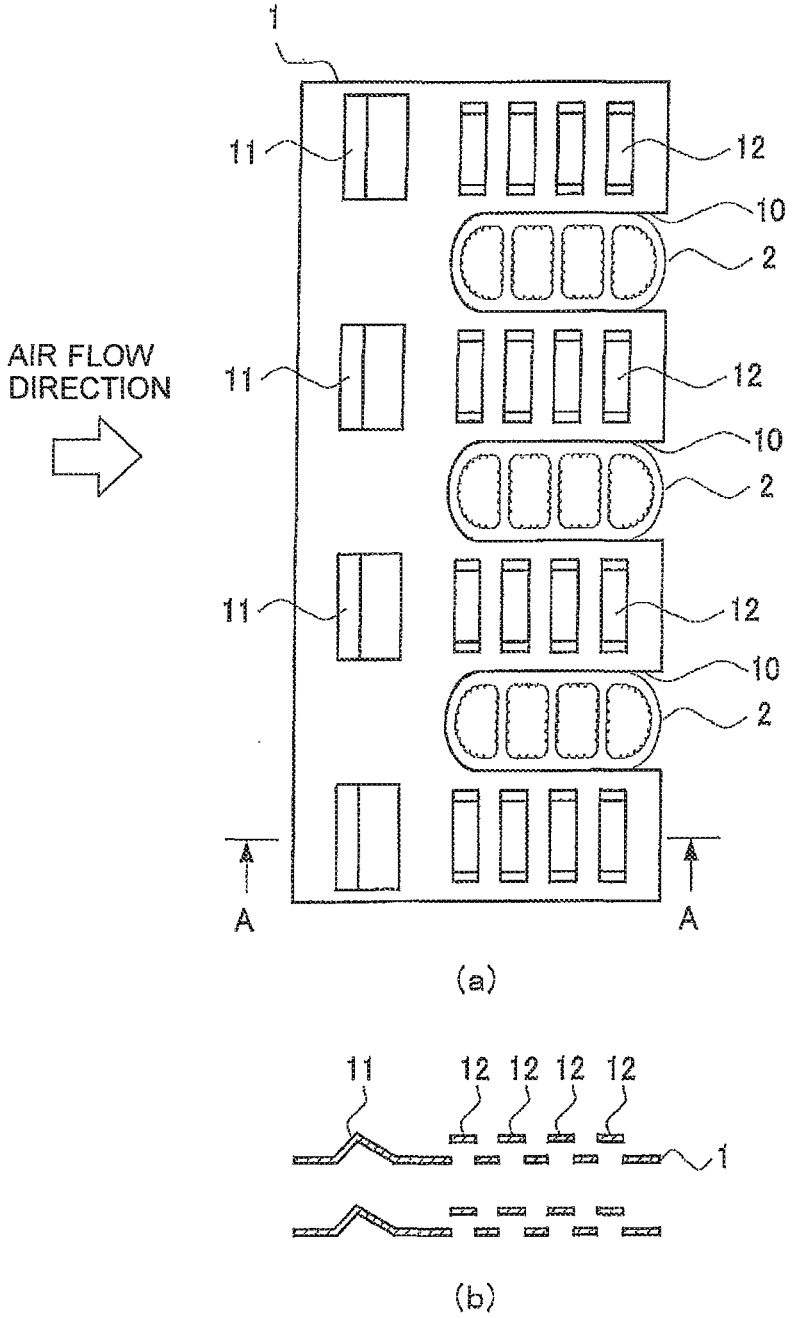
FIG. 1 is a configuration diagram of a heat exchanger according to Embodiment 1 of the present invention.

FIG. 1 is a configuration diagram of a heat exchanger according to Embodiment 1 of the present invention. FIG. 1(*a*) is a view illustrating a positional relationship between plate fins and heat transfer pipes, and FIG. 1(*b*) is a cross sectional view of FIG. 1(*a*) taken along the line A-A. In FIG. 1, an essential part of the heat exchanger is schematically shown.

As shown in FIG. 1, a fin tube type heat exchanger according to Embodiment 1 includes plate fins 1 and flat pipes 2 which are heat transfer pipes. The heat exchanger is mounted, for example, on an air-conditioning apparatus and exchanges heat of a fluid such as air (hereinafter, also referred to as air flow) flowing through the heat exchanger and a refrigerant (medium) flowing in the flat pipe 2.

The flat pipe 2 is a heat transfer pipe having a flat or wedge-shaped cross section. A plurality of flat pipes 2 are arranged with the longitudinal direction of the flat shape oriented in a flow direction of a fluid (right and left direction in the sheet of drawing) and spaced from each other in the short direction of the flat shape (up and down direction in the sheet of drawing). Headers are connected to both ends of the flat pipes 2 so that the refrigerant is delivered to each of the plurality of flat pipes 2. Further, a plurality of refrigerant flow paths separated by partitions are formed in the flat pipe 2.

The plate fin 1 has a plate shape. A plurality of plate fins 1 are stacked with a predetermined space therebetween and allows a fluid to flow between the plate fins 1.

Further, notches 10 are formed on the downstream end of the plate fin 1 so that the plurality of flat pipes 2 are inserted therein. The air flow upstream side of the flat pipes 2 is inserted into the respective notches 10 and the notches 10 are connected to the plurality of flat pipes 2. The air flow upstream side of a portion of the plate fin 1 which has the notches 10 is formed in a flat shape.

Further, waffle structures 11 and slit structures 12 are formed on the plate fin 1.

The waffle structures 11 are disposed on the air flow upstream side of the slit structures 12. The waffle structure 11 is formed by bending a portion of the plate fin 1 to form a protrusion having an angle-shaped cross section which protrudes in the stack direction of the plate fins 1 and having a ridge substantially perpendicular to the air flow direction. Further, the waffle structures 11 are disposed on the upstream side of the upstream end of the flat pipes 2. Since the waffle structures 11 are provided, a vortex can be generated in the air flow, thereby facilitating heat exchange between the plate fin 1 and the air flow.

The slit structures 12 are disposed on the air flow downstream side of the waffle structures 11. The slit structures 12 are formed by cutting and raising a portion of the plate fin 1 with an opening facing the air flow direction. A plurality of slit structures 12 are arranged in the air flow direction. Further, the slit structures 12 are disposed on the downstream side of the upstream end of the flat pipes 2. Since the slit structures 12 are provided, a temperature boundary layer is formed by the leading edge effect, thereby facilitating heat exchange between the plate fin 1 and the air flow. Thermal conductivity of the slit structures 12 is higher than that of the waffle structures 11.

Next, an assembly process of the fin tube type heat exchanger of this embodiment will be described.

For example, the plate fin 1 is formed by a fin punching process by using a die press machine. Then, the flat pipes 2 are inserted into the notches 10 of the plate fin 1 so that the plate fin 1 is in close contact with the flat pipes 2. Since the flat pipe 2 has a flat or wedge-shaped cross section, the flat pipes 2 are inserted into the plate fin 1 without a gap, thereby ensuring good contact between the plate fin 1 and the flat pipe 2.

Then, the flat pipes 2 are brazed to the plate fin 1. One or two pieces of rod-shaped brazing material having a length smaller than the width of the flat pipe 2 are disposed at the end of the flat pipes 2. The flat pipes 2 are placed in Nocolok continuous furnace and heat bonded. Finally, the plate fin 1 is treated with a hydrophilic coating material. Alternatively, the flat pipes 2 may be brazed by applying a brazing material on the flat pipes 2 in advance. Applying a brazing material on the flat pipes 2 in advance may reduce the operation time for placing the rod-shaped brazing material on the flat pipes 2, thereby improving production efficiency. Alternatively, a clad fin having a brazing material cladded in advance on one or both ends of plate fin 1 may be used.

Next, one example of air-conditioning apparatus which includes the foregoing heat exchanger will be described.

Figure 2:
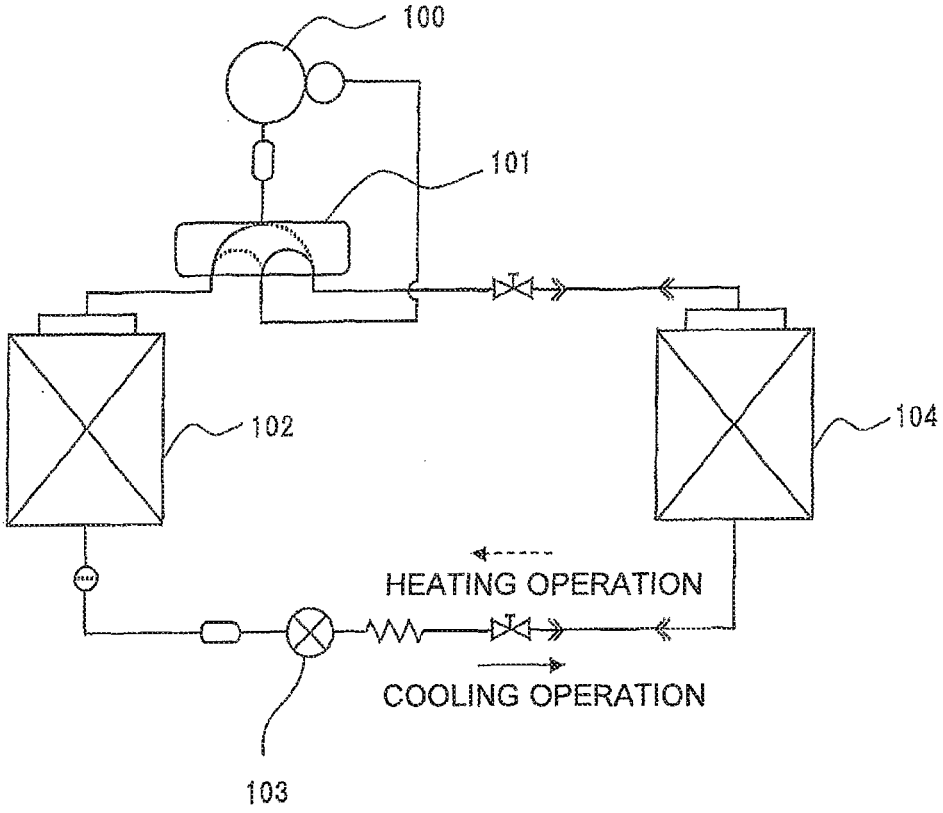
FIG. 2 is a configuration diagram of an air-conditioning apparatus according to Embodiment 1 of the present invention.

FIG. 2 is a configuration diagram of an air-conditioning apparatus according to Embodiment 1 of the present invention.

As shown in FIG. 2, the air-conditioning apparatus includes a refrigerant circuit formed of a compressor 100, a four-way valve 101, an outdoor side heat exchanger 102 mounted on an outdoor unit, an expansion valve 103 which is expansion means, and an indoor side heat exchanger 104 mounted on an indoor unit, which are connected in sequence by refrigerant pipes so that a refrigerant circulates therethrough.

The four-way valve 101 changes a flow direction of refrigerant in the refrigerant circuit to switch a heating operation and a cooling operation. Further, in an air-conditioning apparatus for exclusively cooling or heating operation only, the four-way valve 101 may be omitted.

The outdoor side heat exchanger 102 corresponds to the above described fin tube type heat exchanger and functions as a condenser that heats air or the like by using heat of the refrigerant during cooling operation and as an evaporator that cools air or the like by using heat of evaporation generated by evaporation of the refrigerant during heating operation.

The indoor side heat exchanger 104 corresponds to the above described fin tube type heat exchanger and functions as an evaporator for the refrigerant during cooling operation and as a condenser for the refrigerant during heating operation.

The compressor 100 compresses the refrigerant flowed out of the evaporator and heats the refrigerant to a high temperature and supplies to the condenser.

The expansion valve 103 expands the refrigerant flowed out of the condenser and cools the refrigerant to a low temperature and supplies to the evaporator.

The above described fin tube type heat exchanger may be used for at least one of the outdoor side heat exchanger 102 and the indoor side heat exchanger 104.

Next, a resistance to frost formation of the heat exchanger according to Embodiment 1 will be described.

When the heat exchanger functions as an evaporator, the refrigerant of low temperature (for example, 0 degrees C. or lower) flows in the flat pipes 2. In this case, moisture in the air (water vapor) passing between the stacked plate fins 1 is condensed and deposited as frost (frost formation).

In Embodiment 1, the waffle structures 11 are disposed on the air flow upstream side, and the slit structures 12 having thermal conductivity higher than that of the waffle structures 11 are disposed on the downstream side of the waffle structures 11. Accordingly, the waffle structures 11 having lower thermal conductivity can contribute to decrease the amount of frost formation on the upstream side where the absolute humidity in the air is high and frost formation is likely to occur. Further, since the air having a decreased absolute humidity due to frost formation on the waffle structures 11 passes the slit structures 12 which have high thermal conductivity, the amount of frost formation on the slit structure 12 can be decreased compared with the case where the waffle structures 11 are not provided. Accordingly, moisture in the air passing between the stacked plate fins 1 is dispersed to the waffle structures 11 and the slit structures 12 and frosted, thereby preventing the air flow resistance between the plate fins 1 from being increased due to frost formation, and improving a resistance to frost formation.

Further, in Embodiment 1, the waffle structures 11 are disposed on the upstream side of the upstream end of the flat pipes 2, and the slit structures 12 are disposed on the downstream side of the upstream end of the flat pipes 2. Accordingly, the amount of heat transferred from the flat pipe 2 to the slit structure 12 becomes larger than to the waffle structure 11, and the thermal conductivity of the slit structure 12 can be increased higher than that of the waffle structure 11. As a result, the amount of frost formation on the upstream side where the absolute humidity in the air is high and frost formation is likely to occur can be decreased by using the waffle structures 11 having lower thermal conductivity. Further, since the air having a decreased absolute humidity due to frost formation on the waffle structures 11 passes the slit structures 12 which have high thermal conductivity, the amount of frost formation on the slit structure 12 can be decreased compared with the case where the waffle structures 11 are not provided. Accordingly, it is possible to prevent the air flow resistance between the plate fins 1 from being increased due to frost formation and improve a resistance to frost formation.

Next, a cross sectional shape of the waffle structure 11 will be described.

Figure 3:
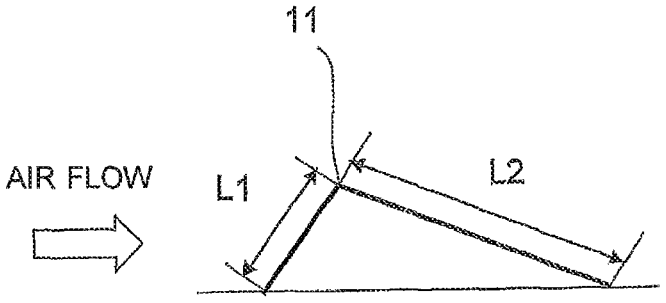
FIG. 3 is a schematic view of a cross section of a waffle structure according to Embodiment 1 of the present invention.

FIG. 3 is a schematic view of a cross sectional shape of a waffle structure according to Embodiment 1 of the present invention.

As shown in FIG. 3, the waffle structure 11 has a slant length L1 on the upstream side thereof which is smaller than a slant length L2 on the downstream side.

Further, when a plurality of waffle structures 11 are continuously formed, it is desirable that a sequence of slant lengths L1 on the upstream side thereof which is smaller than the slant lengths L2 on the downstream side is continuously formed. That is, when the waffle structures 11 of the plate fin 1 are continuously formed such that hills and valleys are alternatively arranged vertically to the air flow direction, it is desirable that a sequence of slant lengths L1 on the upstream side of the waffle structures which are smaller than the slant lengths L2 on the downstream side is continuously formed.

An effect caused by those structures will be described with reference to FIGS. 4 and 5.

Figure 4:
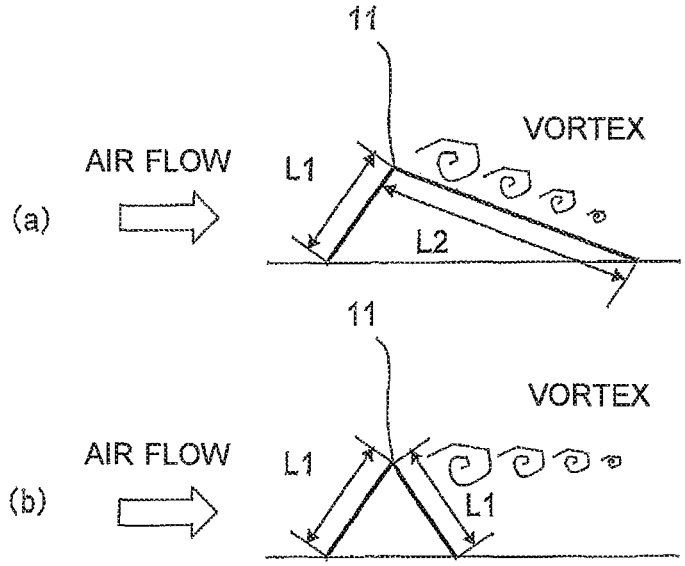
FIG. 4 is a view illustrating an effect of the waffle structure according to Embodiment 1 of the present invention.

FIG. 4 is a view illustrating an effect of the waffle structure according to Embodiment 1 of the present invention. FIG. 4(*a*) shows the waffle structure 11 of Embodiment 1, while FIG. 4(*b*) shows the waffle structure 11 having the same slant length (slant length L1 ) on the upstream side and the downstream side.

As shown in FIG. 4(*a*), the air flow which collides the upstream side of the waffle structure 11 becomes turbulent on a slant surface and generates a vortex. This vortex flows along the slant surface having a longer slant length on the downstream side, and facilitates heat exchange between the plate fin 1 and the air flow. On the other hand, when the slant lengths on the upstream side and the downstream side are the same as shown in FIG. 4(*b*), the vortex tends to be separated from the slant surface on the downstream side, and heat exchange between the air flow flowing on the downstream side of the waffle structure 11 and the plate fin 1 is not smoothly performed.

Figure 5:
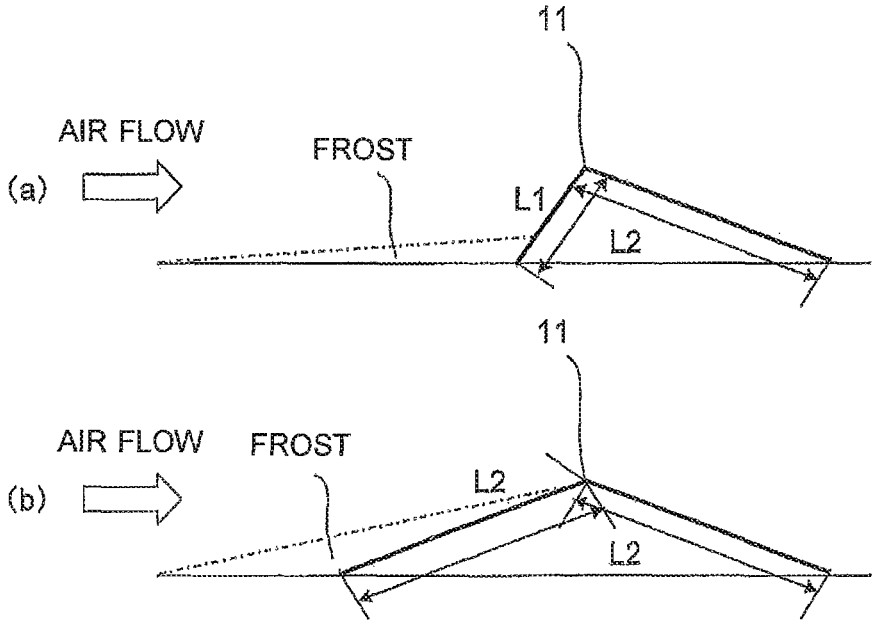
FIG. 5 is a view illustrating an effect of the waffle structure according to Embodiment 1 of the present invention.

FIG. 5 is a view illustrating an effect of the waffle structure according to Embodiment 1 of the present invention. FIG. 5(*a*) shows the waffle structure 11 of Embodiment 1, while FIG. 5(*b*) shows the waffle structure 11 having the same slant length (slant length L2 ) on the upstream side and the downstream side.

Since the absolute humidity in the air of the air flow which collides the slant surface on the upstream side of the waffle structure 11 is high, frost formation is likely to occur on the slant surface on the upstream side of the waffle structure 11. As shown in FIG. 5(*a*), since the waffle structure 11 of Embodiment 1 has a smaller slant length on the upstream side, frost deposited on the surface is thin compared with the case of FIG. 5(*b*) in which the slant surface on the upstream side is longer, and accordingly, the air flow resistance can be reduced.

As described above, since the slant length L1 on the upstream side of the waffle structure 11 is smaller than the slant length L2 on the downstream side in Embodiment 1, the air flow passing the waffle structures 11 can be prevented from being separated, and heat exchange capacity can be improved. Further, it is possible to prevent the air flow resistance between the plate fins 1 from being increased due to frost formation and improve a resistance to frost formation.

Next, drainage behavior of condensed water generated in the heat exchanger will be described.

Figure 6:
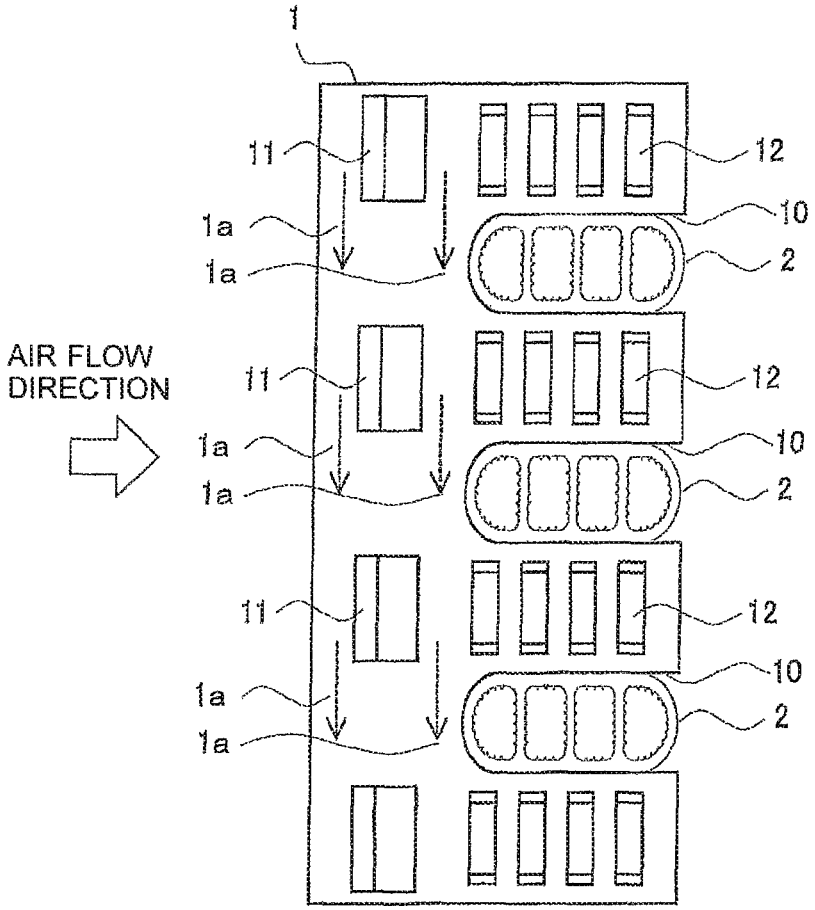
FIG. 6 is a view illustrating a drainage behavior of condensed water in the heat exchanger according to Embodiment 1 of the present invention.

FIG. 6 is a view illustrating a drainage behavior of condensed water in the heat exchanger according to Embodiment 1 of the present invention.

As shown in FIG. 6, the heat exchanger is mounted on the air-conditioning apparatus such that an arrangement direction (stack direction) of the plurality of flat pipes 2 is oriented in the gravity direction.

When the heat exchanger exchanges heat between the air flowing in the heat exchanger and the refrigerant flowing in the flat pipes 2, water vapor contained in the air is condensed on the surface of the plate fins 1 and the flat pipes 2, and water drops (condensed water) are generated. Further, for example during defrosting operation, frost deposited on the plate fins 1 and the flat pipes 2 is dissolved into water drops.

In the heat exchanger according to this embodiment, a flat portion on the air flow upstream side of the plate fin 1 (air flow upstream side relative to the notches 10) serves as a drain passage 1*a* in which the condensed water flows, thereby improving drainage of condensed water.

Embodiment 2

Figure 7:
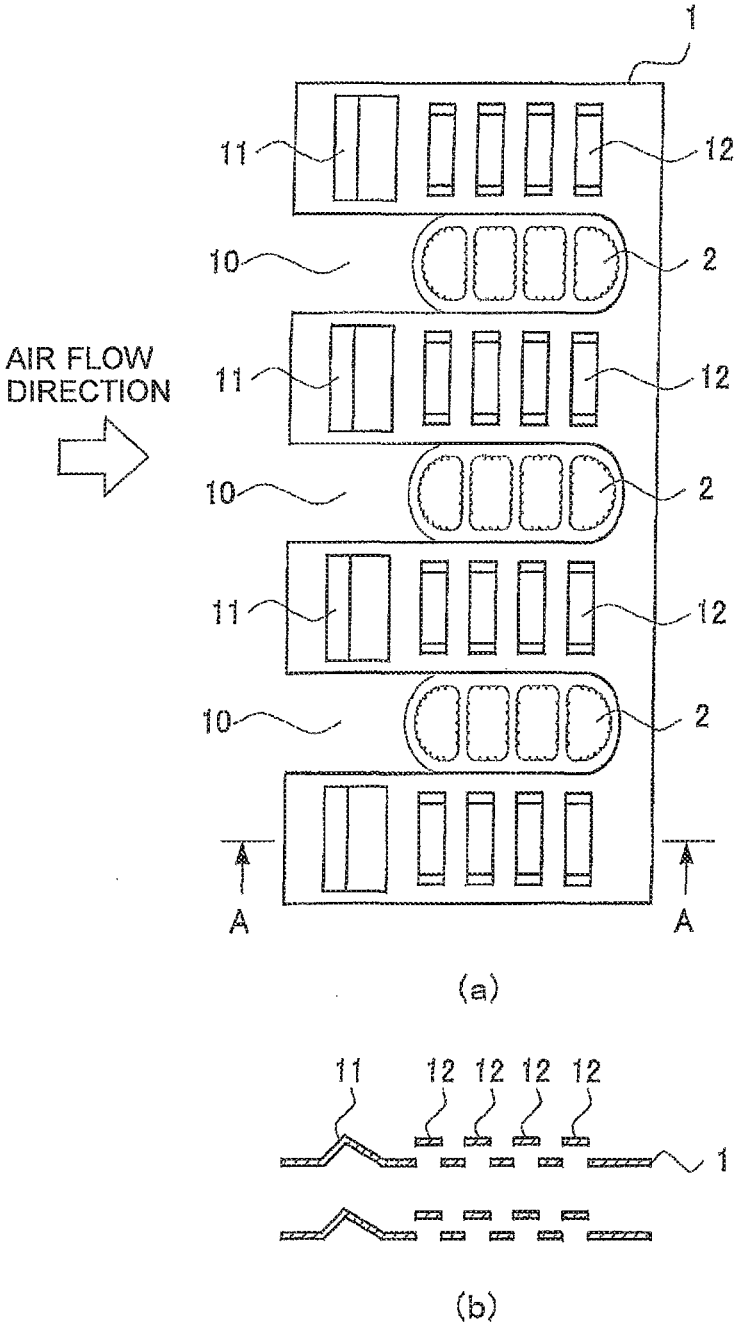
FIG. 7 is a configuration diagram of the heat exchanger according to Embodiment 2 of the present invention.

FIG. 7 is a configuration diagram of the heat exchanger according to Embodiment 2 of the present invention. FIG. 7(*a*) shows a positional relationship between the plate fins and the heat transfer pipes, and FIG. 7(*b*) is a cross sectional view of FIG. 7(*a*) taken along the line A-A. Further, in FIG. 7, an essential part of the heat exchanger is schematically shown.

As shown in FIG. 7, in Embodiment 2, the notches 10 are formed on the upstream end of the plate fin 1 so that the plurality of flat pipes 2 are inserted therein. The air flow downstream side of the portion of the plate fin 1 which has the notches 10 is formed in a flat shape.

In Embodiment 2, the waffle structures 11 and the slit structures 12 are also formed on the plate fin 1.

The waffle structures 11 are disposed on the air flow upstream side of the slit structures 12. The waffle structures 11 are disposed on the upstream side of the upstream end of the flat pipes 2.

The slit structures 12 are disposed on the air flow downstream side of the upstream end of the flat pipes 2. Further, the slit structures 12 are formed on the upstream side of the downstream end of the flat pipes 2.

Other configurations are the same as those of Embodiment 1, and the same elements are denoted by the same reference numerals.

Similar to Embodiment 1, since the waffle structures 11 are disposed on the air flow upstream side and the slit structures 12 are disposed on the downstream side of the waffle structures 11 in Embodiment 2, it is possible to prevent the air flow resistance between the plate fins 1 from being increased due to frost formation, and improve a resistance to frost formation.

Further, in Embodiment 2, the slit structures 12 are disposed on the upstream side of the downstream end of the flat pipes 2, and part of the plate fin 1 on the air flow downstream side of the notches 10 is formed as a flat section. Accordingly, a buckling strength of the plate fin 1 can be improved. That is, when the plate fin 1 is brazed to the flat pipes 2, a buckling strength of the plate fin 1 can be improved and the rigidity of the plate fin 1 can be increased even if durability of the plate fin 1 is decreased due to the plate fin 1 being annealed by brazing, since part of the plate fin 1 on the air flow downstream side of the notches 10 is formed as a flat section.

Further, the waffle structures 11 are disposed on the upstream side of the upstream end of the flat pipes 2. Accordingly, the waffle structures 11 serve as reinforcement ribs, thereby improving a buckling strength of the plate fin 1 and improving rigidity of the plate fin 1.

As a result, even in the case where the fins tend to easily collapse on the plate fin 1 during a bending process of the heat exchanger (for example, L-shaped bending), collapse of the fins can be prevented, and the air flow resistance caused by collapse of the fins can be prevented from being increased, thereby preventing decrease of heat exchange capacity.

Next, drainage behavior of condensed water generated in the heat exchanger will be described.

Figure 8:
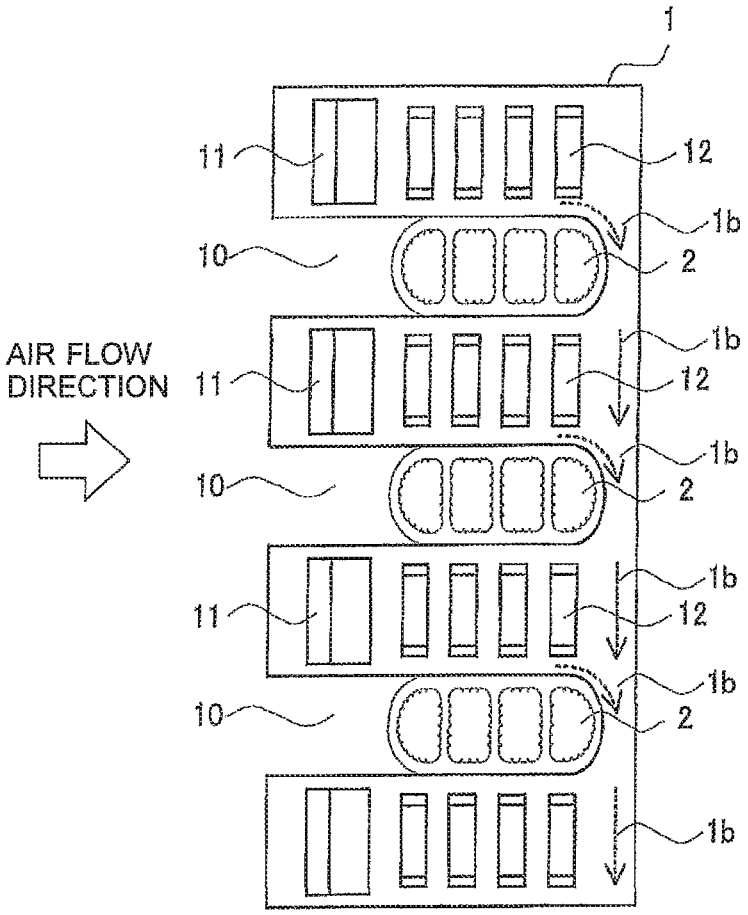
FIG. 8 is a view illustrating a drainage behavior of condensed water in the heat exchanger according to Embodiment 2 of the present invention.

FIG. 8 is a view illustrating a drainage behavior of condensed water in the heat exchanger according to Embodiment 2 of the present invention.

As shown in FIG. 8, the heat exchanger is mounted on the air-conditioning apparatus such that an arrangement direction (stack direction) of the plurality of flat pipes 2 is oriented in the gravity direction.

In the heat exchanger according to Embodiment 2, a flat portion on the air flow downstream side of the plate fin 1 (air flow downstream side relative to the notches 10) serves as a drain passage 1*b* in which the condensed water flows, thereby improving drainage of condensed water.

Embodiment 3

Figure 9:
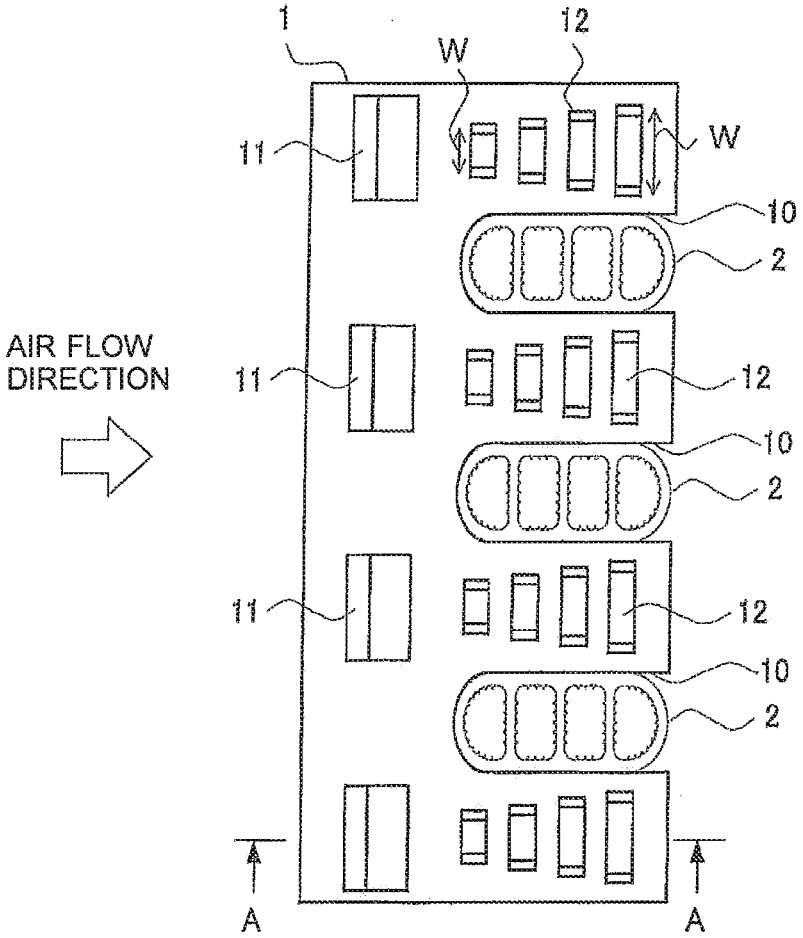
FIG. 9 is a configuration diagram of the heat exchanger according to Embodiment 3 of the present invention.
Figure 9:
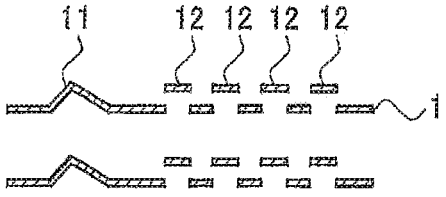

FIG. 9 is a configuration diagram of the heat exchanger according to Embodiment 3 of the present invention. FIG. 9(*a*) shows a positional relationship between the plate fins and the heat transfer pipes, and FIG. 9(*b*) is a cross sectional view of FIG. 9(*a*) taken along the line A-A. Further, in FIG. 9, an essential part of the heat exchanger is schematically shown.

As shown in FIG. 9, in Embodiment 3, a plurality of slit structures 12 are formed on the plate fin 1 such that the opening width of the slit structure 12 on the downstream side is larger than the opening width of the slit structure 12 on the upstream side. That is, an opening width W of the slit gradually increases from the upstream side to the downstream side.

Other configurations are the same as those of Embodiment 1 or 2, and the same elements are denoted by the same reference numerals. Although FIG. 9 shows an example in which the notches 10 are formed on the downstream side, the notches 10 may be formed on the upstream side similarly to Embodiment 2.

As described above, in Embodiment 1, since the opening width of the slit structure 12 is small on the upstream side where the absolute humidity in the air is high and frost formation is likely to occur, it is possible to ensure a flow passage for the air flow, prevent the air flow resistance between the plate fins 1 from being increased due to frost formation, and improve a resistance to frost formation. Further, since the opening width of the slit structure 12 is large on the downstream side, it is possible to ensure thermal conductivity for performing heat exchange between the plate fin 1 and the air flow.

Embodiment 4

Figure 10:
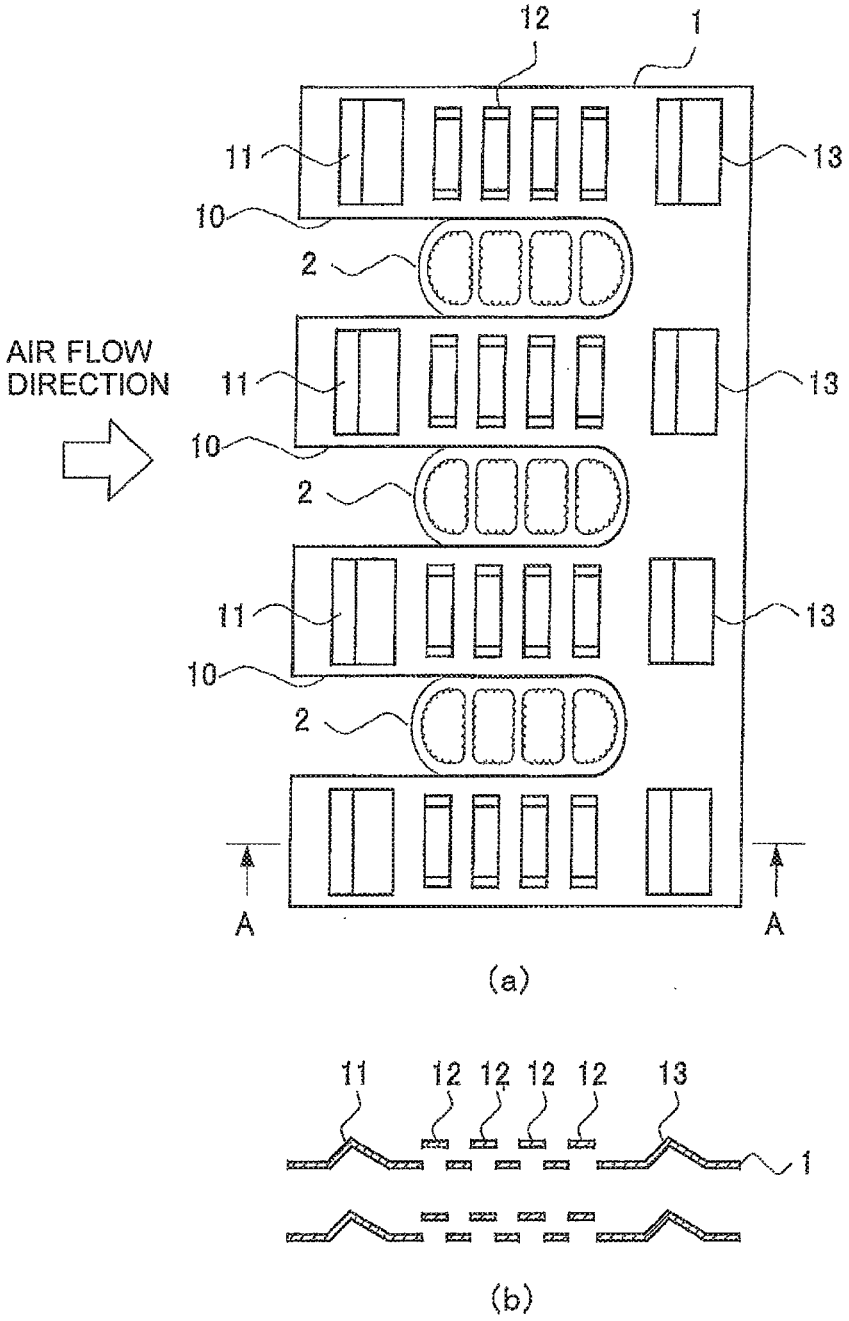
FIG. 10 is a configuration diagram of the heat exchanger according to Embodiment 4 of the present invention.

FIG. 10 is a configuration diagram of the heat exchanger according to Embodiment 4 of the present invention. FIG. 10(*a*) shows a positional relationship between the plate fins and the heat transfer pipes, and FIG. 10(*b*) is a cross sectional view of FIG. 10(*a*) taken along the line A-A.

As shown in FIG. 10, in addition to the waffle structures 11 and the slit structures 12 on the downstream side of the waffle structures 11, second waffle structures 13 are formed on the downstream side of the slit structures 12 on the plate fin 1 in Embodiment 4. Other configurations are the same as those of Embodiments 1 to 3, and the same elements are denoted by the same reference numerals.

The second waffle structure 13 is formed by bending a portion of the plate fin 1 to form a protrusion having an angle-shaped cross section which extends in the stack direction of the plate fins 1 and having a ridge being substantially perpendicular to the air flow direction. Further, the second waffle structures 13 are disposed on the downstream side of the downstream end of the flat pipes 2. Since the second waffle structures 13 are provided, a vortex can be generated in the air flow, thereby facilitating heat exchange between the plate fin 1 and the air flow.

Further, in Embodiment 4, part of the plate fin 1 on the air flow downstream side of the notches 10 is formed as a flat section. Accordingly, a buckling strength of the plate fin 1 can be improved. That is, when the plate fin 1 is brazed to the flat pipes 2, a buckling strength of the plate fin 1 can be improved and the rigidity of the plate fin 1 can be increased even if durability of the plate fin 1 is decreased due to the plate fin 1 being annealed by brazing, since part of the plate fin 1 on the air flow downstream side of the notches 10 is formed as a flat section.

Further, the second waffle structures 13 are disposed on the downstream side of the downstream end of the flat pipes 2 (air flow downstream side relative to the notches 10). Accordingly, the second waffle structures 13 serve as reinforcement ribs, thereby improving a buckling strength of the plate fin 1 and improving rigidity of the plate fin 1.

As a result, even in the case where the fins tend to easily collapse on the plate fin 1 during a bending process of the heat exchanger (for example, L-shaped bending), collapse of the fins can be prevented, and the air flow resistance caused by collapse of the fins can be prevented from being increased, thereby preventing decrease of heat exchange capacity.

Next, drainage behavior of condensed water generated in the heat exchanger will be described.

Figure 11:
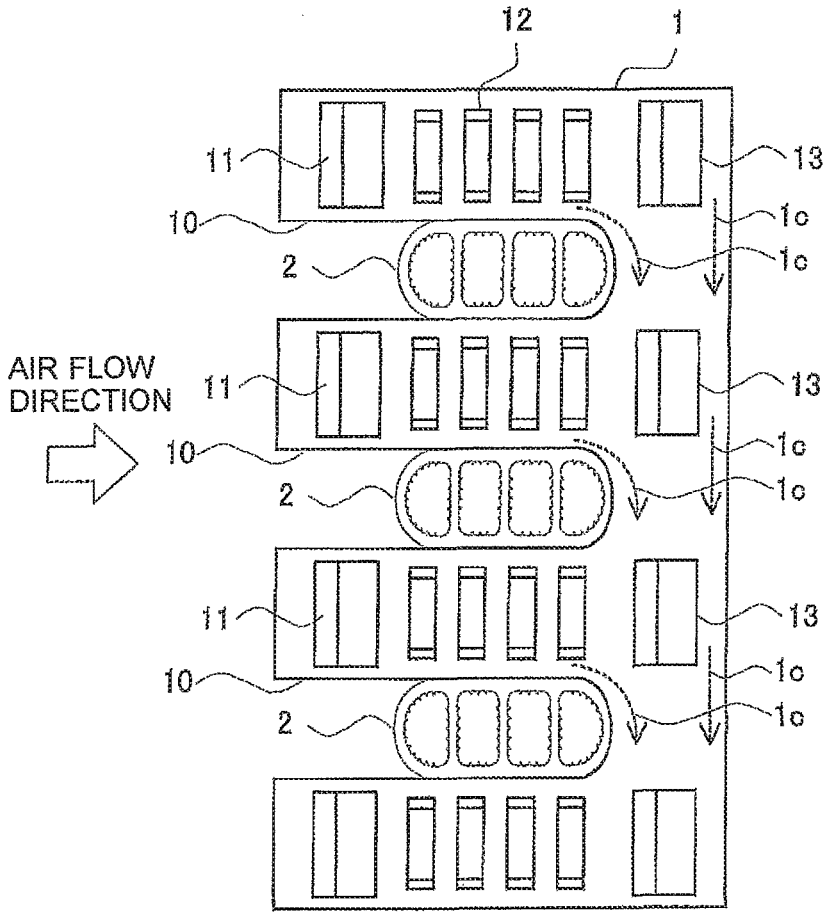
FIG. 11 is a view illustrating a drainage behavior of condensed water in the heat exchanger according to Embodiment 4 of the present invention.

FIG. 11 is a view illustrating a drainage behavior of condensed water in the heat exchanger according to Embodiment 4 of the present invention.

As shown in FIG. 11, the heat exchanger is mounted on the air-conditioning apparatus such that an arrangement direction (stack direction) of the plurality of flat pipes 2 is oriented in the gravity direction.

In the heat exchanger according to Embodiment 4, a flat portion on the air flow downstream side of the plate fin 1 (air flow downstream side relative to the notches 10) serves as a drain passage 1*c* in which the condensed water flows, thereby improving drainage of condensed water.

Figure 12:
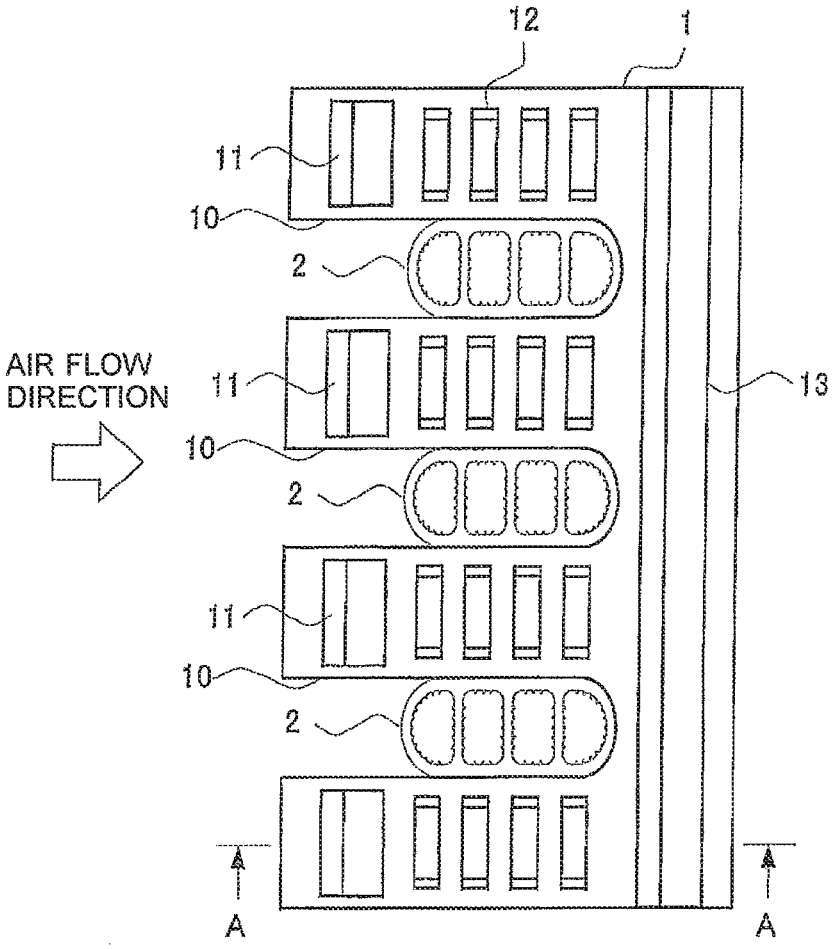
FIG. 12 is another configuration diagram of the heat exchanger according to Embodiment 4 of the present invention.
Figure 12:
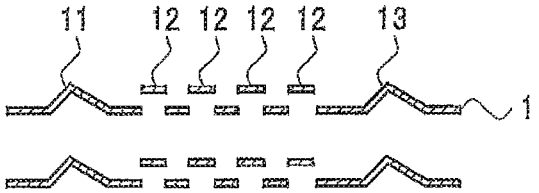

Although FIGS. 10 and 11 shows that a plurality of second waffle structures 13 are provided for each of the flow paths of air flow between the flat pipes 2, the invention is not limited thereto. For example, as shown in FIG. 12, an integrally formed second waffle structure 13 may be provided for the plurality of flat pipes 2. Such a configuration can provide a similar effect. Further, since the second waffle structure 13 is integrally formed, the second waffle structure 13 serves as a drain groove and can improve drainage of condensed water.

Further, although Embodiments 1 to 4 has described that the notches 10 are formed on a plurality of plate fins 1 so that a plurality of heat transfer pipes (flat pipes 2) are inserted into the notches 10, the invention is not limited thereto. The notches 10 may be omitted, and openings into which a plurality of heat transfer pipes are inserted may be formed on a plurality of plate fins 1 so that each heat transfer pipe is inserted into the opening.

Further, although Embodiment 1 to 4 has described the case where the plurality of heat transfer pipes inserted in the plurality of plate fins 1 are flat pipes 2 which have high thermal conductivity and a resistance to frost formation which is easily lowered, the invention is not limited thereto. For example, the plurality of heat transfer pipes inserted in the plurality of plate fins 1 may be round pipes. Such a configuration can provide a similar effect.

Figure 13:
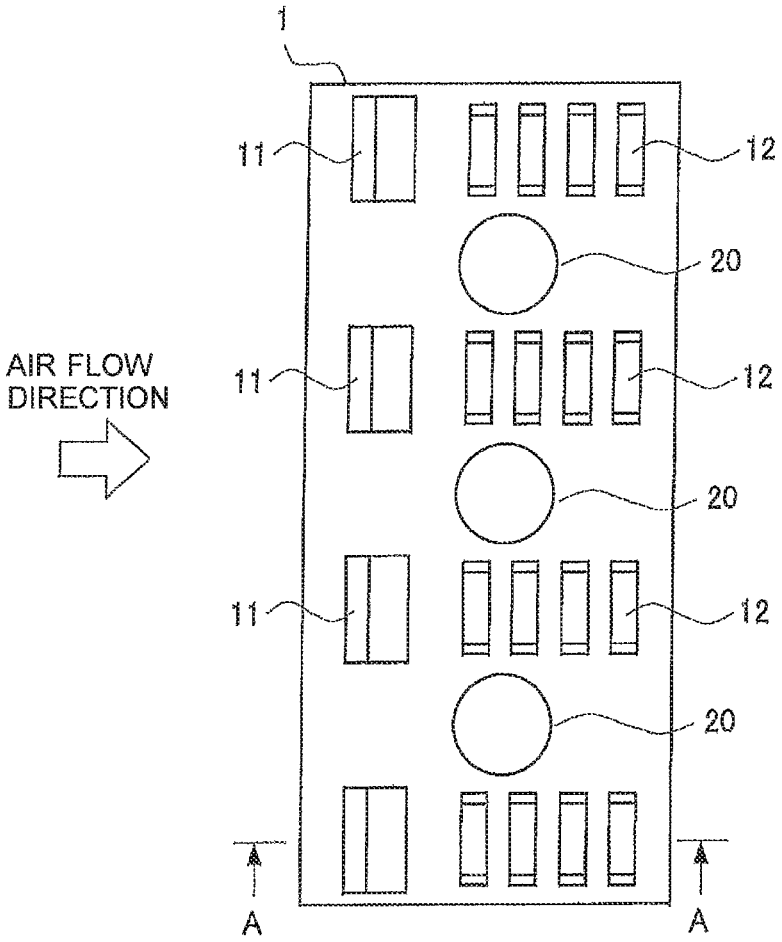
FIG. 13 is another configuration diagram of the heat exchanger according to Embodiment 1 of the present invention.
Figure 13:
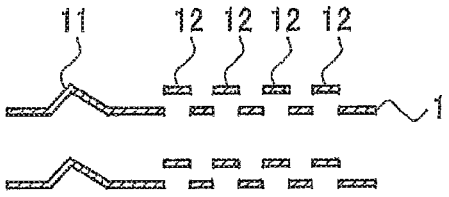

For example, as shown in FIG. 13, round pipes 20 may be used instead of the flat pipes 2 which are described in the configuration of Embodiment 1. Further, the notches 10 may be omitted, and round openings may be formed on the plurality of plate fins 1 so that the round pipes 20 are inserted.

REFERENCE SIGNS LIST

1 plate fin 1*a* drain passage 1*b* drain passage 1*c* drain passage 2 flat pipe 10 notch 11 waffle structure 12 slit structure 13 second waffle structure 20 round pipe 100 compressor 101 four-way valve 102 outdoor side heat exchanger 103 expansion valve 104 indoor side heat exchanger

The invention claimed is:

1. A heat exchanger comprising:

a plurality of plate fins which are stacked at intervals and allow a fluid to flow between the plate fins; and a plurality of heat transfer pipes disposed in the plate fins and in which a medium that exchanges heat with the fluid flows therethrough, wherein each of the plate fins includes a slit structure formed at a portion of the plate fin to form an opening facing a flow direction of the fluid, and a protrusion formed by bending a portion of the plate fin which protrudes in a stack direction of the plate fins and having a slant on an upstream side and a slant on a downstream side in the flow direction of the fluid, and the protrusion is disposed on the upstream side of the flow direction of the fluid with respect to the slit structure.

2. The heat exchanger of claim 1, wherein a plurality of notches are formed on the plurality of plate fins, and the plurality of heat transfer pipes are composed of flat pipes and are disposed in the notches of the plurality of plate fins.

3. The heat exchanger of claim 2, wherein, in the plate fins, the notches are formed at an end of the downstream side of the flow direction of the fluid.

4. The heat exchanger of claim 2, wherein, in the plate fins, the notches are formed at an end of the upstream side of the flow direction of the fluid.

5. The heat exchanger of claim 1, wherein, in the plate fins, the protrusion on the plate fins is formed on the upstream side of the flow direction of the fluid upper than the heat transfer pipes.

6. The heat exchanger of claim 1, wherein, in the plate fins, the slit structure on the plate fins is formed on the upstream side upper than a downstream end of the heat transfer pipes.

7. The heat exchanger of claim 1, wherein the slit structure on the plate fins is formed on the downstream side lower than an upstream end of the heat transfer pipes.

8. The heat exchanger of claim 1, wherein a plurality of slit structures on the plate fins comprising the slit structure are formed in the flow direction of the fluid such that an opening width of the slit structures on the downstream side is larger than an opening width of the slit structures on the upstream side.

9. The heat exchanger of claim 1, wherein the plate fins include a second protrusion that is disposed on the downstream side of the flow direction of the fluid with respect to the slit structure and formed by bending a portion of the plate fin which protrudes in a stack direction of the plate fins and having a slant on an upstream side and a slant on a downstream side in the flow direction of the fluid.

10. An air-conditioning apparatus comprising:

a refrigerant circuit including a compressor, a condenser, an expansion device, and an evaporator, which are connected in sequence by pipes so as to circulate a refrigerant therethrough, wherein the heat exchanger of claim 1 is used for at least one of the condenser and the evaporator, and the heat exchanger is provided such that an arrangement direction of the plurality of heat transfer pipes are oriented in a gravity direction.

11. The heat exchanger of claim 1, wherein the protrusion has an angle-shaped cross section, and a slant length on the upstream side thereof is smaller than a slant length on the downstream side thereof.

* * * * *